United States Patent [19]

Moore

[11] Patent Number: 4,676,471

[45] Date of Patent: Jun. 30, 1987

[54] PORTABLE STAND FOR A TREE

[76] Inventor: Charles E. Moore, 420 Magazine St., Tupelo, Miss. 38801

[21] Appl. No.: 768,239

[22] Filed: Aug. 22, 1985

[51] Int. Cl.[4] ..... F16M 13/00

[52] U.S. Cl. ..... 248/526; 248/527

[58] Field of Search ..... 248/526, 525, 524, 523, 248/519, 522, 527

[56] References Cited

U.S. PATENT DOCUMENTS

| | | | |
|---|---|---|---|
| 1,579,275 | 4/1926 | Zeigler | 248/526 |
| 1,874,119 | 8/1932 | Propst | 248/526 X |
| 1,876,276 | 9/1932 | Danner | 248/526 X |
| 2,028,129 | 1/1936 | Allerton | 248/526 X |
| 3,473,771 | 10/1969 | Newman | 248/526 X |
| 3,519,230 | 7/1970 | Meade | 248/526 |
| 3,815,854 | 6/1974 | Zipser | 248/526 X |
| 4,007,901 | 2/1977 | Mancini et al. | 248/526 |
| 4,496,129 | 1/1985 | Waterman et al. | 248/527 |

*Primary Examiner*—Ramon O. Ramirez
*Attorney, Agent, or Firm*—E. Lieberstein

[57] ABSTRACT

A portable stand for supporting a tree in an erect upright position off the ground including at least three legs which radially extend from a common central location in which the tree is placed, cross brace members which connect the legs for pivotal motion about common points of attachment, a container for the tree and arm supports pivotally connected to the cross brace members and the container such that the container moves vertically down in response to the weight of the tree until the legs grip the tree.

9 Claims, 3 Drawing Figures

FIG. 1
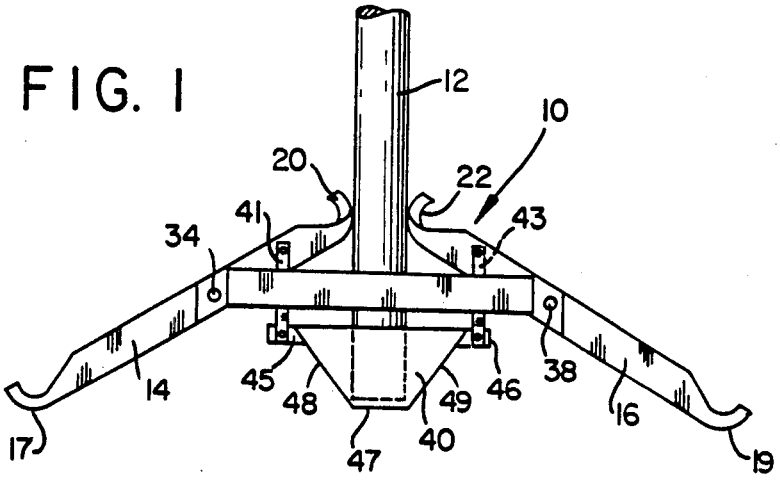
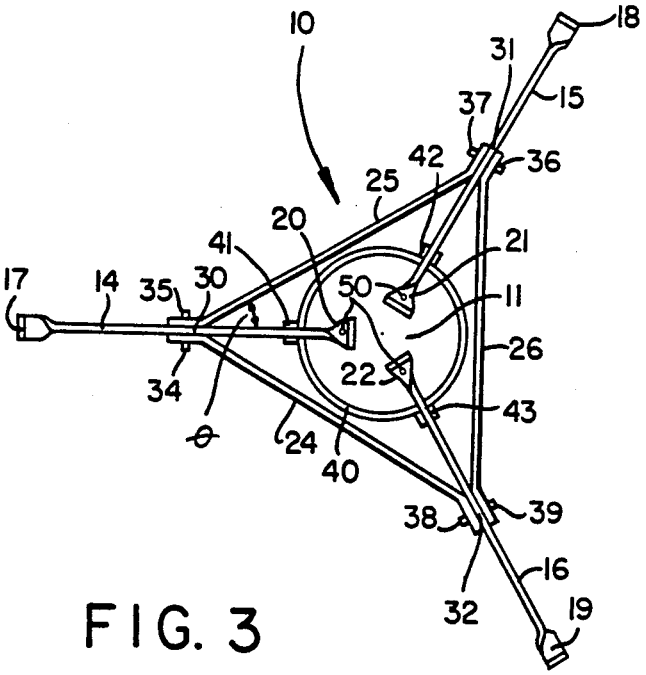
FIG. 3

PORTABLE STAND FOR A TREE

This invention relates to a portable stand for supporting a Christmas tree or pole in an erect upright position off the ground.

BACKGROUND OF THE INVENTION

Commercially available tree stands are unwieldy structures designed to accommodate a limited number of specific tree trunk sizes. Some of the conventional tree stands even require attachment to the ground to support the tree. The tree stand of the present invention automatically sizes itself to accommodate any tree trunk diameter over a wide range of diameters and does not require attachment to the ground. In addition, the tree stand of the present invention is easily assembled, requires limited space and may be readily disassembled for storage.

SUMMARY OF THE INVENTION

The stand of the present invention is adapted to hold a Christmas tree or pole in an upright erect position off the ground and comprises;

a plurality of at least three legs radially and symmetrically extending from a common central location in which the tree is to be placed, with each leg having a bottom end adapted to contact the ground and a top end adapted to engage and support the tree in the upright position;

a plurality of elongated cross brace members corresponding to the number of legs;

means for connecting each cross brace member to one another in a symmetrical arrangement about common points of attachment with each leg pivotally connected to two cross members at their common point of attachment;

container means for receiving the bottom of the tree with the container means vertically disposed in alignment with the common central location; and means connecting the legs to the container means such that the container means is urged downwardly in a vertical direction in response to the weight of the tree until the top end of each leg is clamped against the tree trunk.

OBJECTS OF THE INVENTION

It is accordingly the principal object of the present invention to provide a Christmas tree stand which will accommodate a wide range of tree sizes and which will hold the tree upright in an erect vertical position.

It is a further object of the present invention to provide a Christmas tree stand which is inexpensive to manufacture, easily assembled and disassembled and is portable.

DESCRIPTION OF THE DRAWINGS

Other objects and advantages of the present invention will become apparent from the following description of the preferred embodiment when read in conjunction with the accompanying drawings of which:

FIG. 1 is a side elevation of the Christmas tree stand of the present invention shown supporting a relatively small diameter tree;

FIG. 3 is a top view of the stand of FIG. 1.

DESCRIPTION OF THE PREFERRED EMBODIMENT

Figure 2:
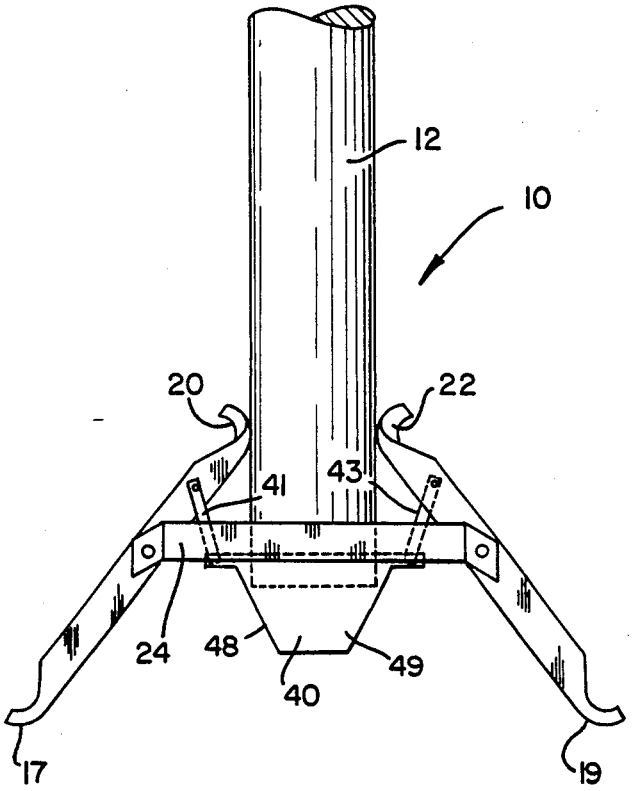
FIG. 2 is another side elevation of the stand of FIG. 1 shown supporting a tree trunk with a much larger diameter than that of FIG. 1.

Referring to FIGS. 1–3 inclusive in which the preferred embodiment of the present invention is shown comprising a stand 10 which supports the trunk 12 of a Christmas tree or other pole like member in an erect position, off the ground, and along a substantially vertical axis.

The stand 10 includes three legs 14, 15 and 16, respectively, although additional legs may be used. The legs 14, 15 and 16 radially extend from a common central location 11 in which the tree 12 is placed. The legs 14, 15 and 16 are symmetrically oriented relative to one another. Any material of construction may be used for the legs although metal is preferred. The legs 14, 15 and 16 are preferably of rectangular geometry and can be formed from metal stock such that a flat surface is provided on each side to which the cross brace members 24, 25 and 26 are attached. Each leg 14, 15 and 16 should have a bottom end or foot 17, 18 and 19 respectively, which is adapted to contact the ground or floor upon which the stand 10 is to be placed and a top end 20, 21 and 22, respectively. The foot of each leg is intended to slide along the ground or floor when the tree is first inserted into the stand until the top end 20, 21 and 22 of each leg 14, 15 and 16 clamps itself to the tree trunk 12 as will be further elaborated upon later in the description of the specification.

The legs 14, 15 and 16 are maintain radially spaced apart by the cross brace members 24, 25 and 26 respectively. The number of cross brace members should preferably correspond to the number of legs. Each cross brace member 24, 25 and 26 is connected between two of the legs at substantially common points of attachment 30, 31 and 32 respectively. Accordingly and as shown in FIG. 3, cross brace member 24 is connected between the legs 14 and 16, cross brace member 25 is connected between the legs 14 and 15, and cross brace member 26 is connected between legs 15 and 16.

The leg 14 is pivotally connected to the cross brace member 24 and 25 at the common point of attachment 30 by means of a pin 34. The pin 34 may be threaded at one end for attachment to a nut 35 or may be a cotter pin. In either case, the leg 14 freely pivots about the pin 34. Likewise, the leg 15 is pivotally connected to the cross brace members 25 and 26 at the common point of attachment 31 by means of a pin 36 or the like. The pin 36 may be threaded at one end and secured to a nut 37. Similarly, the leg 16 is pivotally connected to the cross brace members 24 and 26 at the common point of attachment 32 by means of a pin 38. The pin 38 may be threaded at one end and secured to a nut 39. Each of the pins 34, 36 and 38 are inserted through holes formed at the points of attachment 30, 31 and 32 between the cross brace members and legs respectively.

The cross brace members 24, 25 and 26 may be fabricated from rectangular strips of metal with the ends of each strip of metal preferably bent toward one another to form substantially equal included angles "$\theta$" relative to the horizontal. An angle "$\theta$" of 30 degrees is preferred for a symmetrical assembly with three legs and three cross brace members. The angle "$\theta$" will vary according to the number of legs in the assembly. The cross brace members 24, 25 and 26 are mounted flush against the legs at the points of attachment 30, 31 and 32 as more clearly shown in FIG. 3.

A container 40 is suspended from the tree stand 10 at the common central location 11 by a plurality of arm supports 41, 42 and 43. Each arm support has one end pivotally connected to a separate leg at a point which lies between the points of attachment 30, 31 and 32 and the top end 20, 21 and 22 of each of the legs respectively. The arm supports 41, 42 and 43 may be formed from flat strips of metal and may be secured to a plurality of ears such as 45 and 46 as shown in FIG. 1, which project from the container 40. The container 40 should be of a size to accommodate any size tree trunk 12. A container 40 with a frusto conical geometry is preferred. The flat bottom of the tree trunk 12 will either rest at the bottom end 47 of the container 40 or against the inclined walls 48 and 49.

The top end 20, 21 and 22 of each of the legs 14, 15 and 16 is forced into engagement against the tree trunk 12 when the tree is placed in the container 40. Each of the top ends 20, 21 and 22 is preferably curved to provide a relatively equal surface area of contact with the tree trunk 12 independent of tree size. The curvature of the top ends 20, 21 and 22 will depend upon the range of tree sizes to be handled by the stand. The top end of each leg may be relatively flat for a narrow range of tree trunk diameters whereas a more rounded curvature would be required for a wide range of tree trunk diameters. FIG. 1 shows the stand 10 holding a thin tree trunk 12 whereas FIG. 2 shows the same stand 10 with a much larger diameter tree trunk 12. The stand may accommodate tree diameters of between $\frac{3}{4}$ to 4 inches in diameter.

A number of openings 50 (not shown) may be formed in the top ends 20, 21 and 22 of the legs. Nails, spikes or screws may be driven into the tree through such holes to provide additional support particularly if the stand and tree are to be moved as one unit. Ordinarily, the tree will stand erect without requiring nails or screws, etc., to be placed through the top ends of the legs. The screws or nails will also operate to minimize tree rotation.

In operation, the bottom end of a tree or other pole like object is inserted into the container 40. The central location 11 about which the tree trunk is placed is sized to receive a tree by moving the bottom ends of the legs toward one another. The container 40 moves only along a vertical direction by the arm supports 41, 42 and 43 which pivot to maintain the vertical orientation of the container 40. The pivoting arm supports 41, 4Z and 43 prevent lateral movement of the container. Since the container will not tilt it may be filled with soil, water, etc. to preserve and lengthen the life of the tree.

Once the tree is in place in the container 40 the weight of the tree causes the container to move downwardly along a vertical axis. The container 40 continues to move downwardly in response to the weight of the tree until the top ends 20, 21 and 22 of the legs are clamped against the body of the tree trunk. The weight of the tree is transferred to the trunk of the tree at the junction between the abutting face of the top end of the legs and the trunk. As the container 40 moves down the legs 14, 15 and 16, pivot about the points of attachment 30, 31 and 23 between the cross brace members 24, 25 and 26 to force engagement of the top ends against the tree trunk.

What I claim is:

1. A stand for holding the trunk of a tree or pole in an upright position, off the ground, comprising:

a plurality of at least three legs radially and symmetrically extending from a common central location in which the tree trunk is to be placed, with each leg having a bottom end adapted to contact the ground and a top end adapted to engage and support the tree in an upright position off the ground;

a plurality of elongated cross brace members corresponding to the number of legs;

means for connecting each cross brace member to one another in a symmetrical arrangement about common points of attachment and for pivotally connecting said legs to the cross brace members at said common points of attachment;

container means into which the tree trunk is to be placed with said container means bein substantially disposed in alignment with the common central location; and means for connecting said legs to said container means such that the stand may accomodate a tree of any size diameter over a wide range of diameters with said container means automatically maintaining a level position along a vertical axis extending through said central location, independent of the tree diameter, said means comprising a plurality of arm supports with each arm pivotally connected at one end thereof to each leg at a location between the top end of said leg and the common point of attachment of said leg to the brace members and with the opposite end of each arm support connected to said container means.

2. A stand as defined in claim 1 wherein the opposite end of each arm support is pivotally connected to the container means.

3. A stand as defined in claim 2 wherein said container means has a frusto conical geometry adapted to accommodate a wide range of trunk diameters.

4. A stand as defined in claim 3 wherein said container means has a plurality of ears with each ear connected to the opposite end of one of the arm supports.

5. A stand as defined in claim 3 wherein said means for connecting each cross brace member to one another and for pivotally connecting said legs to the cross brace members at their common points of attachment comprises a plurality of pins with each pin connecting two cross brace members and a leg at each point of attachment such that the leg may pivot about said point of attachment.

6. A stand as defined in claim 5 wherein each cross brace member is in the form of a rectangular strip with the opposite end of each strip angled inwardly relative to one another to form a predetermined included angle relative to the horizontal.

7. A stand as defined in claim 6 wherein said included angle is thirty degrees.

8. A stand as defined in claim 5 wherein the top end of each leg is curved.

9. A stand as defined in claim 8 wherein the top end of each leg further comprises openings through which means may be driven for additionally securing the tree to the stand.

* * * * *